US009159510B2

(12) United States Patent
Urakami

(10) Patent No.: US 9,159,510 B2
(45) Date of Patent: Oct. 13, 2015

(54) FIXED CONTACT STRUCTURE

(75) Inventor: Shuhei Urakami, Makinohara (JP)

(73) Assignee: Yazaki Corporation, Tokyo (JP)

( * ) Notice: Subject to any disclaimer, the term of this patent is extended or adjusted under 35 U.S.C. 154(b) by 81 days.

(21) Appl. No.: 13/580,852

(22) PCT Filed: Jun. 1, 2011

(86) PCT No.: PCT/JP2011/063088

§ 371 (c)(1),
(2), (4) Date: Aug. 23, 2012

(87) PCT Pub. No.: WO2011/158702

PCT Pub. Date: Dec. 22, 2012

(65) Prior Publication Data

US 2012/0325631 A1 Dec. 27, 2012

(30) Foreign Application Priority Data

Jun. 14, 2010 (JP) ..... 2010-135159

(51) Int. Cl.

| | |
|---|---|
| ***H01R 13/02*** | (2006.01) |
| ***H01H 15/00*** | (2006.01) |
| ***H01H 1/40*** | (2006.01) |
| ***H01H 19/58*** | (2006.01) |

(52) U.S. Cl.

CPC ..... *H01H 15/005* (2013.01); *H01H 1/403* (2013.01); *H01H 19/585* (2013.01); *H01H 2001/406* (2013.01)

(58) Field of Classification Search

CPC ... H01H 1/403; H01H 1/40; H01H 2001/406; H01H 15/005

USPC ..... 200/531, 536, 547–550, 252, 258

See application file for complete search history.

(56) References Cited

U.S. PATENT DOCUMENTS

| | | | | |
|---|---|---|---|---|
| 4,152,565 | A * | 5/1979 | Rose | 200/292 |
| 4,922,063 | A | 5/1990 | Shimizu et al. | |
| 5,155,306 | A * | 10/1992 | Iijima et al. | 200/292 |
| 6,072,138 | A * | 6/2000 | Sato | 200/550 |
| 6,979,786 | B2 | 12/2005 | Aukland et al. | |
| 2005/0205396 | A1 | 9/2005 | Aukland et al. | |

FOREIGN PATENT DOCUMENTS

| | | | |
|---|---|---|---|
| GB | 633037 | A | 12/1949 |
| JP | 62-144017 | U | 9/1987 |
| JP | 63-158720 | A | 7/1988 |
| JP | 8227630 | A | 9/1996 |

(Continued)

OTHER PUBLICATIONS

International Search Report dated Sep. 14, 2011 from the International Searching Authority in counterpart application No. PCT/JP2011/063088.

(Continued)

*Primary Examiner* — Felix O Figueroa
(74) *Attorney, Agent, or Firm* — Sughrue Mion, PLLC

(57) ABSTRACT

There is provided a fixed contact structure, including: a substrate; at least one fixed contact which is disposed on the substrate; a movable contact which slides on the corresponding fixed contact in a sliding direction; a resist layer which is consecutively disposed on the substrate outside both ends of the fixed contact with respect to the sliding direction; and gaps which are formed outside both ends of the fixed contact with respect to a direction orthogonal to the sliding direction.

5 Claims, 5 Drawing Sheets

(56) References Cited

FOREIGN PATENT DOCUMENTS

| | | | |
|---|---|---|---|
| JP | 9147652 | A | 6/1997 |
| JP | 11330658 | A | 11/1999 |

OTHER PUBLICATIONS

Written Opinion dated Sep. 14, 2011 from the International Searching Authority in counterpart application No. PCT/JP2011/063088.

Office Action dated May 27, 2014, issued by the State Intellectual Property Office of the People's Republic of China in counterpart Chinese Application No. 201180016972.4

Office Action dated Mar. 18, 2014 issued by the Japanese Patent Office in counterpart Japanese Patent Application No. 2010-135159.

Office Action dated Dec. 12, 2014 issued by the State Intellectual Property Office of the People's Republic of China in counterpart Chinese Patent Application No. 201180016972.4

* cited by examiner

FIXED CONTACT STRUCTURE

TECHNICAL FIELD

The present invention relates to a fixed contact structure for sliding a movable contact on a board.

BACKGROUND ART

In the past, there have been proposed various types of a fixed contact structure for sliding a movable contact on a board (refer to Patent Literature 1 and Patent Literature 2). FIG. 4 shows an example of the fixed contact structure. In FIG. 4, a board 100 includes a substrate 101, and a resist layer 102 and three fixed contacts 103 which are placed on un upper surface of the substrate 101. Each of the three fixed contacts 103 is aligned at intervals from one another and extended along the same direction. Two of the fixed contacts 103 have the same dimension (longitudinal length), and the other one of the fixed contacts 103 is set to be shorter in length than the two.

The resist layer 102 is disposed without any gaps in the entire periphery of the three fixed contacts 103.

Three movable contacts 110 are disposed at intervals on the board 100. Each of the three movable contacts 110 slides on the corresponding fixed contact 103 and a region of the resist layer 102 which is extended from the corresponding fixed contact 103 along a sliding direction S which corresponds to a longitudinal direction of the fixed contact 103. In this way, an electric signal can be obtained in accordance with a sliding position of the three movable contacts 110.

CITATION LIST

Patent Literature

Patent Literature 1: JP-A-11-330658
Patent Literature 2: JP-A-8-227630

SUMMARY OF INVENTION

Technical Problem

Actually, it is difficult to uniform the thickness (or uniform the height of the surfaces) of the fixed contact 103 and the resist layer 102 which are disposed on the substrate 101 when they are to be produced. Thus, the height of the surface of the resist layer 102 becomes sometimes higher or sometimes lower than the height of the surface of each fixed contact 103. Furthermore, a sliding locus of the movable contact 110 sometimes deviates, as shown in FIG. 5, from the appropriate sliding direction due to the dimensional variations of the constituent parts.

In a case where the height of the surface of the resist layer 102 is larger than the height of the surface of the fixed contact 103, as shown in FIG. 6, the movable contact 110 may deviate in a direction orthogonal to the sliding direction S from the regular sliding locus due to the variation in the sliding locus of the movable contact 110. In this case, the movable contact 110 runs on the resist layer 102, and there occurs a contact defect at the point.

In order to prevent the contact defect due to the movable contact 110 running on the resist layer 102, there is proposed a fixed contact structure in which the resist layer 102 is not provided in the entire periphery of the fixed contact 103. In Patent Literature 2, the resist layer 102 is not provided outside the end of the fixed contact 103 in the sliding direction. When configured in this way, however, there occurs a large step outside the end of the fixed contact 103 in the sliding direction S. If the movable contact 110 slides fast on the large step, there occurs a large contact-chattering or the like.

The present invention has been made to solve the problems as mentioned above, and an object of an aspect of the present invention is to provide a fixed contact structure capable of preventing a chattering of a movable contact as much as possible and also preventing a contact defect due to the movable contact running on a resist layer.

Solution to Problem

According to an aspect of the invention, there is provided a fixed contact structure, including: a substrate; at least one fixed contact which is disposed on the substrate; a movable contact which slides on the corresponding fixed contact in a sliding direction; a resist layer which is consecutively disposed on the substrate outside both ends of the fixed contact with respect to the sliding direction; and gaps which are formed outside both ends of the fixed contact with respect to a direction orthogonal to the sliding direction.

Advantageous Effects of Invention

According to the aspect of the invention, the resist layer is consecutively disposed outside the both ends of the fixed contact with respect to the sliding direction. Since there occurs no large step, the contact chattering can be prevented as much as possible. Further, the gaps are formed outside the both ends of the fixed contact with respect to the direction orthogonal to the sliding direction. Even if the movable contact deviates from the regular sliding locus to the direction orthogonal to the sliding direction, the movable contact hardly runs on the resist layer. Thus, it is possible to prevent the contact defect due to the movable contact running on the resist layer.

DESCRIPTION OF EMBODIMENTS

There is provided a fixed contact structure, including: a substrate; at least one fixed contact which is disposed on the substrate; a movable contact which slides on the corresponding fixed contact in a sliding direction; a resist layer which is consecutively disposed on the substrate outside both ends of the fixed contact with respect to the sliding direction; and gaps which are formed outside both ends of the fixed contact with respect to a direction orthogonal to the sliding direction.

Each of the gaps may be set to a width dimension by which the movable contact do not interfere with the resist layer even if the movable contact deviate from a regular sliding locus to the maximum allowable deviation position in the direction orthogonal to the sliding direction.

The width dimension of each of the gaps may be larger than a width of a portion of the movable contact which contacts the fixed contact when sliding on the fixed contact.

The height of a surface of the fixed contact may be substantially the same as the height of a surface of the resist layer.

There may be provided a switching device including the fixed contact structure as defined above, which is configured to obtain an electric signal in accordance with a sliding position of the movable contact.

Embodiment

Hereinafter, a description is made of an embodiment of the invention with reference to the accompanying drawings.

Figure 1:
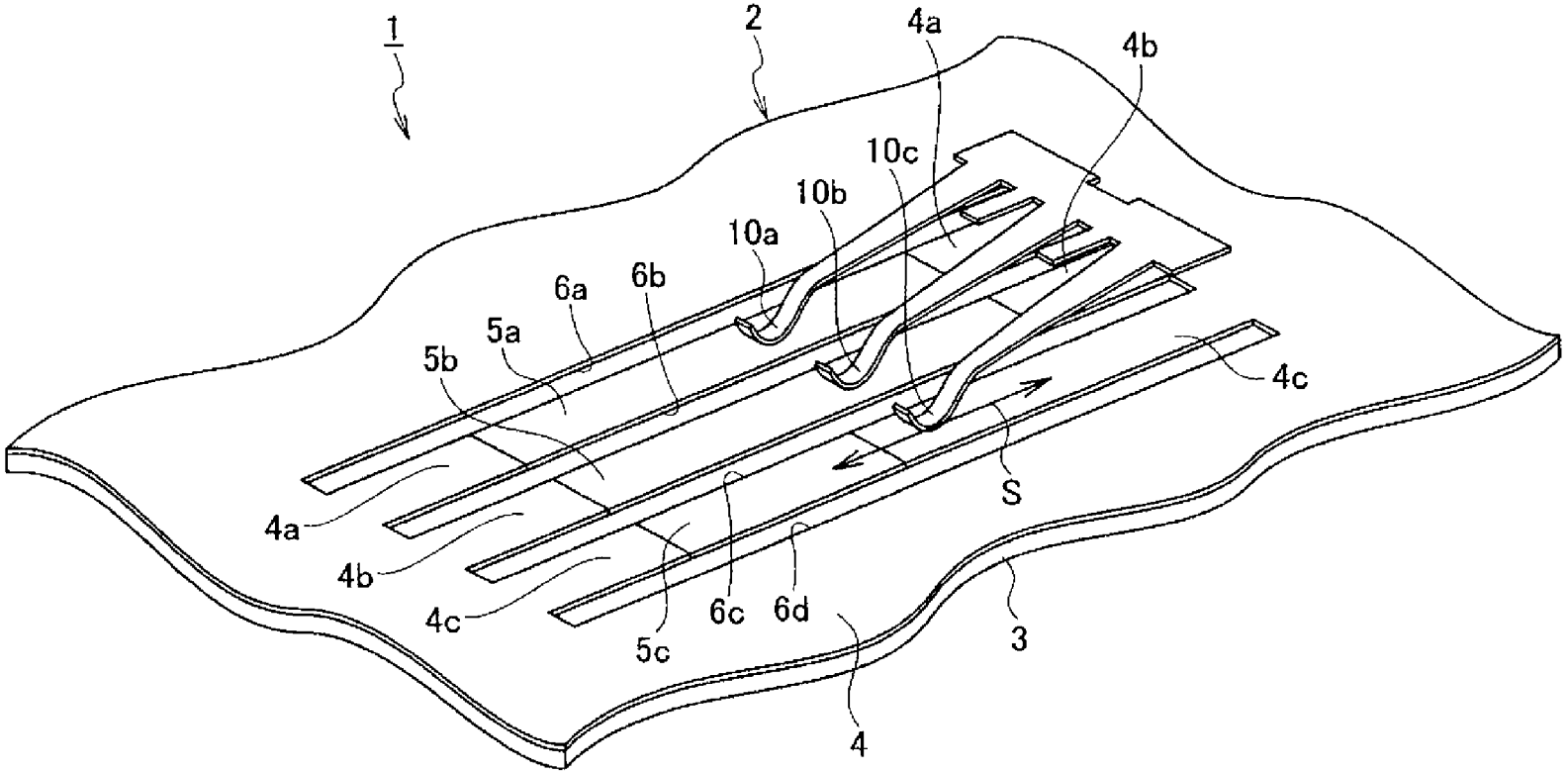
FIG. 1 is a perspective view showing a part of a switching device to which a fixed contact structure according to one embodiment of the invention is applied.
Figure 2:
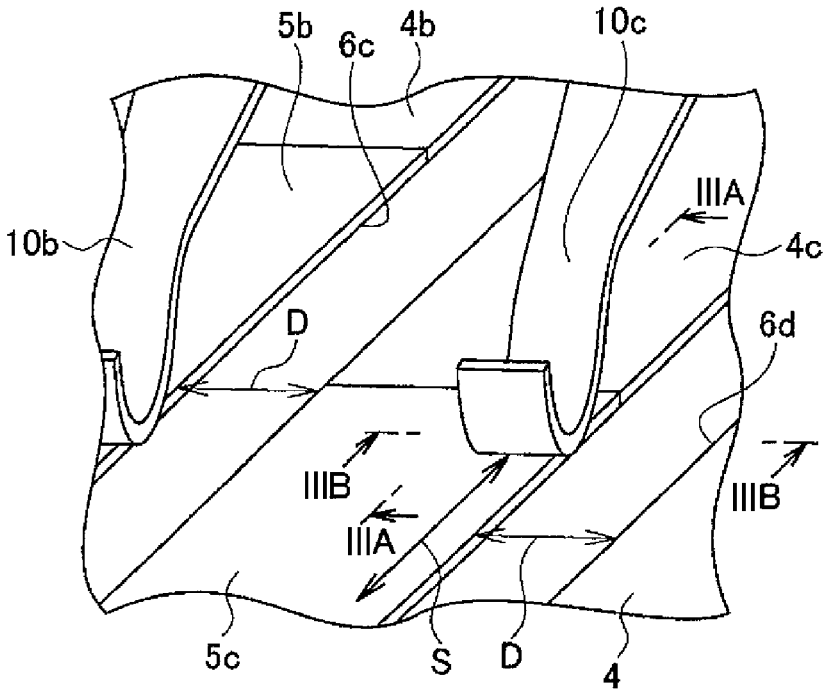
FIG. 2 is a perspective view showing a state where a movable contact deviates in a direction orthogonal to a sliding direction according to the embodiment of the invention.
Figure 3A:
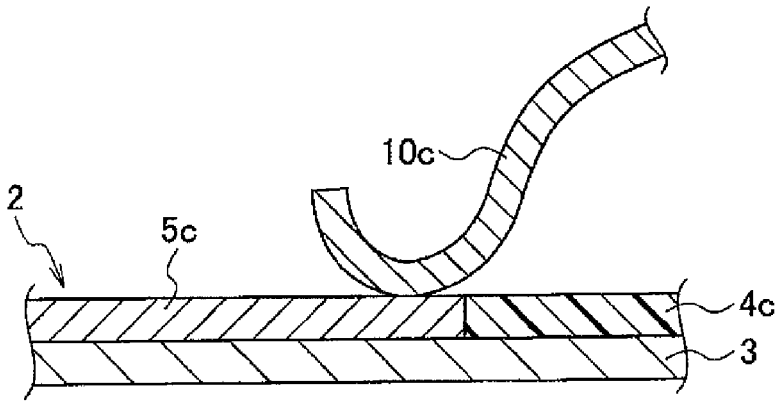
FIG. 3A is a cross sectional view taken from line IIIA-IIIA in FIG. 2.
Figure 3B:
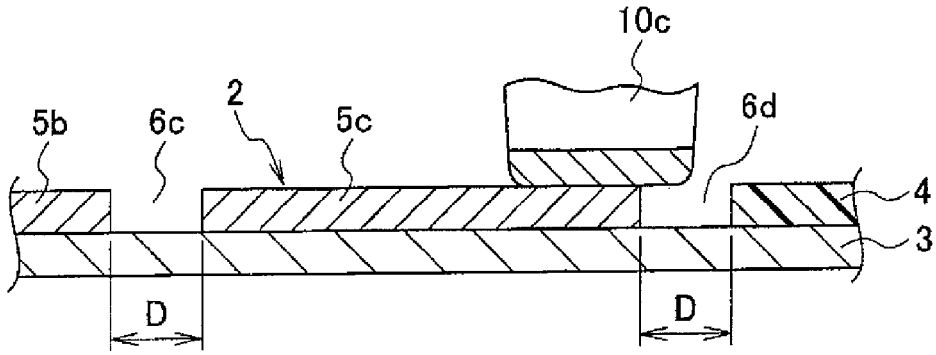
FIG. 3B is a cross sectional view taken from line IIIB-IIIB in FIG. 2.
Figure 4:
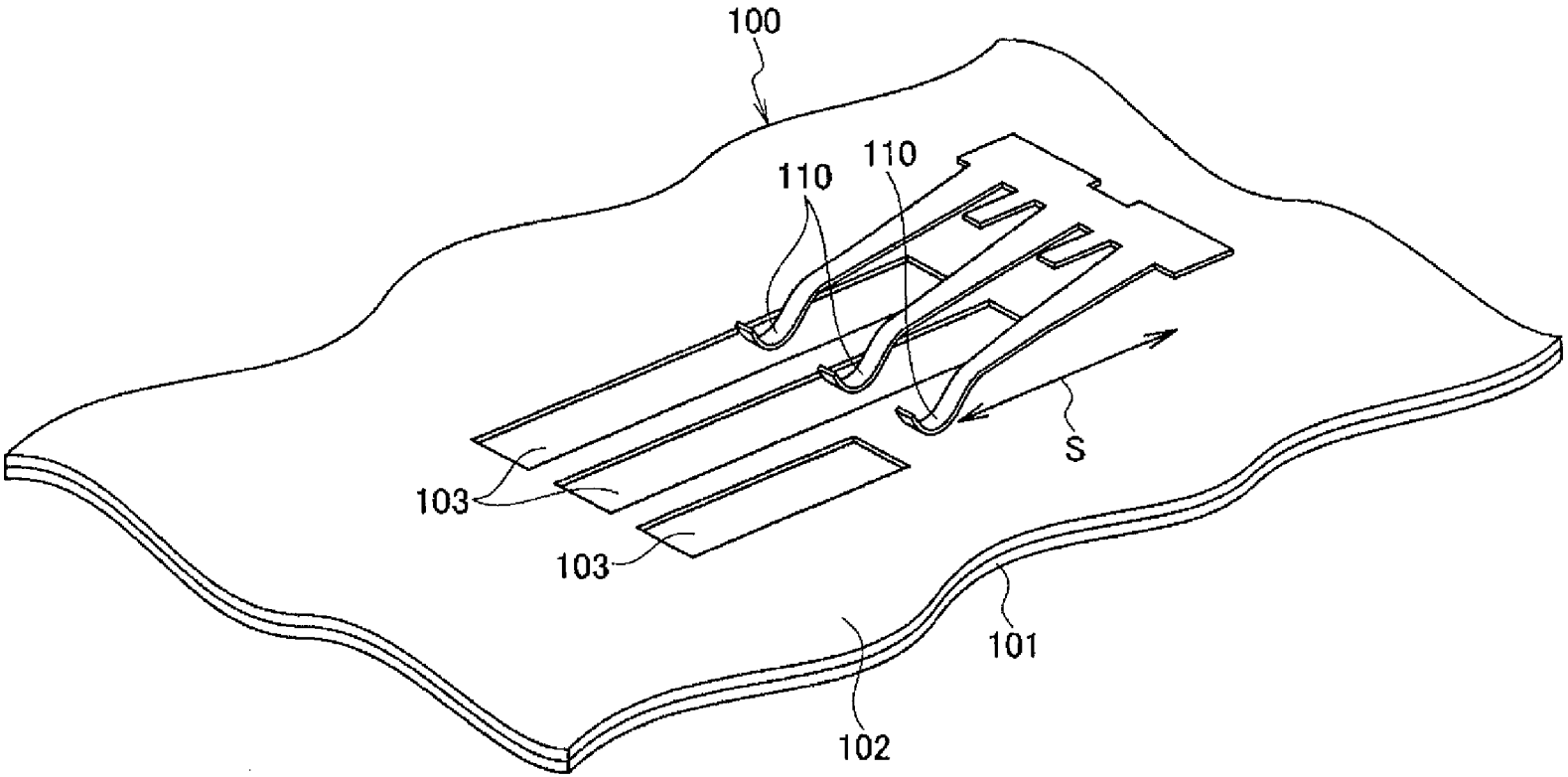
FIG. 4 is a perspective view showing a part of a switching device to which a fixed contact structure according to a related art.
Figure 5:
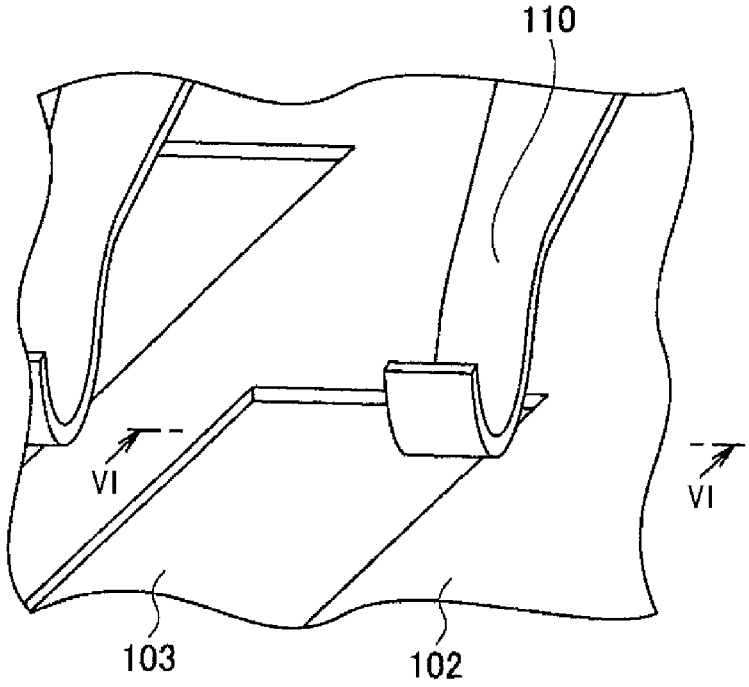
FIG. 5 is a perspective view showing a state where a movable contact deviates in a direction orthogonal to a sliding direction according to the related art.
Figure 6:
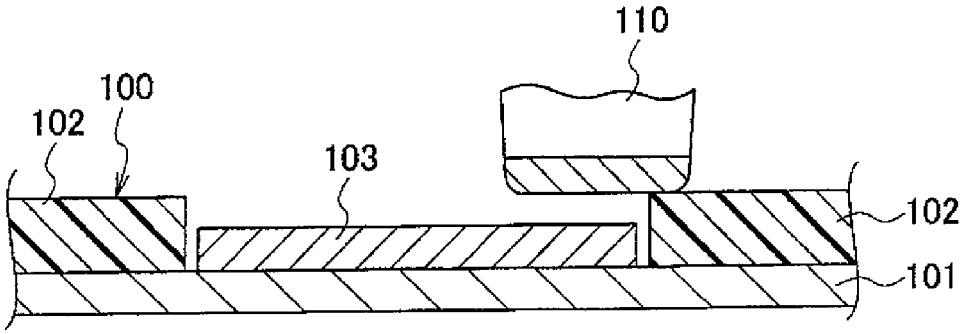
FIG. 6 is a cross sectional view taken from line VI-VI in FIG. 5

FIGS. 1, 2, 3A and 3B show a switching device 1 to which a fixed contact structure according to an embodiment of the invention is applied. In FIG. 1, the switching device 1 includes a board 2 and three movable contacts 10*a* to 10*c* which slide on the board 2.

The board 2 includes an insulating substrate 3. A resist layer 4 and three fixed contacts 5*a* to 5*c* are disposed on an upper surface of the substrate 3. The substrate 3 is made of glass, or epoxy material, for example.

The three fixed contacts 5*a* to 5*c* are conductors (made of copper, for instance), and extend along the same direction while being spaced at intervals from each other. Two fixed contacts 5*a*, 5*b* have the same dimension (longitudinal length), and the other one fixed contacts 5*c* is set to be shorter in length than the two.

The resist layer 4 is made of an insulating material. The height of a surface of the resist layer 4 is set to substantially the same as the height of surfaces of the fixed contacts 5*a* to 5*c*. The resist layer 4 is disposed in the periphery of the three fixed contacts 5*a* to 5*c* except for a partial area thereof. Specifically, the resist layer 4 is disposed consecutively without any gaps outside both ends of the three fixed contacts 5*a* to 5*c* in a sliding direction S. On the other hand, the resist layer 4 is not disposed along an entire area outside both ends of the three fixed contacts 5*a* to 5*c* and sliding sections 4*a* to 4*c* of the resist layer 4 which are disposed on respective extended lines of the sliding direction S of the three fixed contacts 5*a* to 5*c* in the direction orthogonal to the sliding direction S. In the area on the substrate 3, there are gaps 6*a* to 6*d* over the entire area. That is, areas of the fixed contacts 5*a* to 5*c* and the sliding sections 4*a* to 4*c*, and areas of the gaps 6*a* to 6*d* are alternately disposed.

Each of the gaps 6*a* to 6*d* is set to a width dimension D by which the movable contacts 10*a* to 10*c* do not interfere with the resist layer 4 even if the movable contacts 10*a* to 10*c* deviate from the regular sliding locus to the maximum allowable deviation position in the direction orthogonal to the sliding direction S.

The gaps 6*a* to 6*d* are produced as follows, for example. A conductor is formed on areas of the fixed contacts 5*a* to 5*c* and the gaps 6*a* to 6*d* on the substrate 3, and then, a part of the conductor at the areas of gaps 6*a* to 6*d* are etched.

The three movable contacts 10*a* to 10*c* are disposed on or over the board 2 while being spaced from each other at intervals same as those between the fixed contacts 5*a* to 5*c*. The three movable contacts 10*a* to 10*c* slide on the corresponding fixed contacts 5*a* to 5*c* and on the corresponding sliding sections 4*a* to 4*c* of the resist layer 4 which extend from the fixed contacts 5*a* to 5*c* in a longitudinal direction of the fixed contacts 5*a* to 5*c* being regarded as the sliding direction S.

In the above structure, the following states appear in accordance with a sliding position of the three movable contacts 10*a* to 10*c*. All contact areas between the three movable contacts 10*a* to 10*c* and the fixed contacts 5*a* to 5*c* come into a conductive state at a sliding position where all of the three movable contacts 10*a* to 10*c* are located on the respective fixed contacts 5*a* to 5*c*. All contact areas between the three movable contacts 10*a* to 10*c* and the fixed contacts 5*a* to 5*c* come into a non-conductive state at a sliding position where all of the three movable contacts 10*a* to 10*c* are located on the respective sliding sections 4*a* to 4*c* of the resist layer 4. Contact areas between the two movable contacts 10*a*, 10*b* and the fixed contacts 5*a*, 5*b* come into a conductive state and a contact area between the one movable contact 10*c* and the fixed contact 5*c* comes into a non-conductive state at a sliding position where the two movable contacts 10*a*, 10*b* are located on the respective fixed contacts 5*a*, 5*b* and the one movable contact 10*c* is located on the sliding section 4*c* of the resist layer 4. In this way, it is possible to obtain an electric signal in accordance with a sliding position of the three movable contacts 10*a* to 10*c*.

During a sliding process of the movable contacts 10*a* to 10*c*, the sliding sections 4*a* to 4*c* of the resist layer 4 are consecutively disposed outside the ends of the fixed contacts 5*a* to 5*c* in the sliding direction S. Even if the height of the surfaces of the fixed contacts 5*a* to 5*c* cannot be made the same as the height of the surfaces of the sliding sections 4*a* to 4*c* of the resist layer 4, there occurs only a small step. That is, there are no large step as occurred in a case where the resist layer 4 is not provided outside the ends of the fixed contacts 5*a* to 5*c*. Thus, the chattering of the movable contacts 10*a* to 10*c* can be prevented as much as possible. Furthermore, the gaps 6*a* to 6*d* are formed outside the ends of the fixed contacts 5*a* to 5*c* and the sliding sections 4*a* to 4*c* of the resist layer 4, which extend from the fixed contacts 5*a* to 5*c*, with respect to the direction orthogonal to the sliding direction S. Thus, it is possible to prevent the movable contacts 10*a* to 10*c* from running on the resist layer 4 as in the related art even if the movable contacts 10*a* to 10*c* deviate from regular loci to the direction orthogonal to the sliding direction S. Accordingly, it is possible to prevent the contact defect due to the movable contacts 10*a* to 10*c* running on the resist layer 4.

Each of the gaps 6*a* to 6*d* is set to a width dimension D by which the movable contacts 10*a* to 10*c* do not interfere with the resist layer 4 even if the movable contacts 10*a* to 10*c* deviate from the regular sliding locus to the maximum allowable deviation position in the direction orthogonal to the sliding direction S. Preferably, the width dimension D of each of the gaps 6*a* to 6*d* is larger than a width of portions of the movable contacts 10*a* to 10*c* which contact the respective fixed contacts 5*a* to 5*c* when sliding on the fixed contacts 5*a* to 5*c*. Accordingly, it is possible to prevent the contact defect due to the movable contacts 10*a* to 10*c* running on the resist layer 4.

The height of the surfaces of the fixed contact 5*a* to 5*c* is substantially the same as the height of the surface of the resist layer 4 containing the sliding sections 4*a* to 4*c*. Thus, the movable contacts 10*a* to 10*c* slide on boundaries between the fixed contacts 5*a* to 5*c* and the sliding sections 4*a* to 4*c* of the resist layer 4 smoothly with little up/down movement. Accordingly, it is possible to prevent the chattering when the movable contacts 10*a* to 10*c* slide on the respective boundaries between the fixed contacts 5*a* to 5*c* and the sliding sections 4*a* to 4*c* of the resist layer 4.

Although the embodiment describes an example of the three fixed contacts 5*a* to 5*c* and the three movable contacts 10*a* to 10*c*, the number of the contacts is not limited thereto, and may be one, two, four or more. Although the embodiment describes an example of the sliding direction S of the movable contacts 10*a* to 10*c* being a straight direction, the direction is not limited thereto, and may be a circular or an arc direction.

The present invention has been explained in detail with reference to the particular embodiment. However, it is obvious for those skilled in the art that various variations and modifications can be applied without departing from the spirit and the scope of the present invention.

This application is based upon and claims the benefit of priority of Japanese Patent Application No. 2010-135159 filed on Jun. 14, 2010, the contents of which are incorporated herein by reference in its entirety.

INDUSTRIAL APPLICABILITY

The fixed contact structure according to an aspect of the invention as mentioned above can be applied to and useful for, for example, a switching device for obtaining an electric signal in accordance with a sliding position of the movable contact.

REFERENCE SIGNS LIST

3: Substrate
4: Resist layer
5*a*-5*c*: Fixed contact
6*a*-6*d*: Gap
10*a*-10*c*: Movable contact
S: Sliding direction

The invention claimed is:

1. A fixed contact structure, comprising:

a substrate;

fixed contacts, each of which is monolithic and located on the substrate;

movable contacts, each of which is configured to slide on a corresponding one of the fixed contacts in a sliding direction, each of the moveable contacts and each corresponding one of the fixed contacts being arranged in a one-to-one relationship, wherein a conductive contact is formed between each moveable contact and the corresponding one of the fixed contacts when placed in contact; and a resist layer on the substrate at opposing ends of the fixed contacts with respect to the sliding direction, wherein the resist layer is immediately adjacent to the opposing ends of the fixed contacts, and gaps are provided at opposing lateral sides of each of the fixed contacts in a direction orthogonal to the sliding direction, and wherein a height of a surface of the fixed contact is substantially equal to a height of a surface of the resist layer as measured from a common place of reference.

2. The fixed contact structure according to claim 1, wherein each of the gaps is set to a width dimension by which the movable contact does not interfere with the resist layer even if the movable contact deviates from a regular sliding locus to a maximum allowable deviation position in the orthogonal direction.

3. The fixed contact structure according to claim 2, wherein the width dimension of each of the gaps is larger than a width of a portion of the movable contact which contacts the fixed contact when sliding on the fixed contact.

4. A switching device including the fixed contact structure as defined in claim 1, which is configured to obtain an electric signal in accordance with a sliding position of the movable contacts.

5. The switching device according to claim 1, wherein each of the moveable contacts is configured to slide on only the corresponding one of the fixed contacts and the resist layer in a sliding direction.

* * * * *